US010022029B2

(12) United States Patent
Machida et al.

(10) Patent No.: US 10,022,029 B2
(45) **Date of Patent: *Jul. 17, 2018**

(54) ELECTRIC VACUUM CLEANER

(71) Applicant: TOSHIBA LIFESTYLE PRODUCTS & SERVICES CORPORATION, Kawasaki-shi (JP)

(72) Inventors: Yukio Machida, Owariasahi (JP); Masatoshi Tanaka, Seto (JP); Atsushi Morishita, Hadano (JP); Yuji Ohtsuka, Owariasahi (JP); Hiromitsu Ichikawa, Owariasahi (JP); Hiromitsu Murata, Kasugai (JP)

(73) Assignee: TOSHIBA LIFESTYLE PRODUCTS & SERVICES CORPORATION, Kawasaki-shi (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/323,652

(22) PCT Filed: Jul. 2, 2015

(86) PCT No.: PCT/JP2015/069170
§ 371 (c)(1),
(2) Date: Jan. 3, 2017

(87) PCT Pub. No.: WO2016/002894
PCT Pub. Date: Jan. 7, 2016

(65) Prior Publication Data

US 2017/0150862 A1 Jun. 1, 2017

(30) Foreign Application Priority Data

Jul. 4, 2014 (JP) ..... 2014-138309

(51) Int. Cl.
*A47L 9/20* (2006.01)
*A47L 9/28* (2006.01)
*A47L 9/14* (2006.01)

(52) U.S. Cl.
CPC ..... *A47L 9/2873* (2013.01); *A47L 9/1409* (2013.01); *A47L 9/2884* (2013.01); *A47L 9/2894* (2013.01);
(Continued)

(58) Field of Classification Search
CPC .... A47L 9/2873; A47L 9/1409; A47L 9/2884; A47L 9/2894; A47L 2201/04;
(Continued)

(56) References Cited

U.S. PATENT DOCUMENTS 6,076,226 A * 6/2000 Reed ..... A47L 5/28 15/319
2012/0102670 A1 5/2012 Jang et al.
(Continued)

FOREIGN PATENT DOCUMENTS

JP 2012-245344 A 12/2012

OTHER PUBLICATIONS

English translation of the International Preliminary Report on Patentability and Written Opinion dated Jan. 10, 2017 in PCT/JP2015/069170 filed Jul. 2, 2015.
(Continued)

*Primary Examiner* — David Redding
(74) *Attorney, Agent, or Firm* — Oblon, McClelland, Maier & Neustadt, L.L.P.

(57) ABSTRACT

An electric vacuum cleaner, including a cleaning unit includes a body case including a dust container opening, and a primary dust container including: a container body detachably provided to the body case accumulating dust collected by the cleaning unit; a connecting part exposed from or
(Continued)

facing the dust container opening, when attached to the body case; a disposal port provided in the connecting part, for discharging dust from inside the container body; and a disposal lid opening and closing the disposal port. The station includes a dust transfer pipe contacting the connecting part of the primary dust container and connected to the disposal port, and a secondary dust container in which dust discharged from the primary dust container through the dust transfer pipe is accumulated.

17 Claims, 12 Drawing Sheets

(52) U.S. Cl.
CPC ... *A47L 2201/022* (2013.01); *A47L 2201/024* (2013.01); *A47L 2201/04* (2013.01)

(58) Field of Classification Search
CPC ..... A47L 2201/022; A47L 2201/024; A47L 9/28; A47L 9/20
USPC ..... 15/347, 352, 319
See application file for complete search history.

(56) References Cited

U.S. PATENT DOCUMENTS

2012/0291809 A1 11/2012 Kuhe et al.
2013/0031744 A1 2/2013 Ota
2016/0278596 A1* 9/2016 Janzen ..... A47L 9/106

OTHER PUBLICATIONS

International Search Report dated Oct. 6, 2015 in PCT/JP2015/069170 filed Jul. 2, 2015.

* cited by examiner

ELECTRIC VACUUM CLEANER

CROSS-REFERENCE TO RELATED APPLICATIONS

This application claims the benefit of priority of No. PCT/JP2015/069170, filed on Jul. 2, 2015, and the PCT application is based upon and claims the benefit of priority from Japanese Patent Application No. 2014-138309 filed on Jul. 4, 2014, the entire contents of each of which are incorporated herein by reference.

FIELD

An embodiment according to the present invention relates to an electric vacuum cleaner.

BACKGROUND

There is known an electric vacuum cleaner including an autonomous robotic vacuum cleaning unit autonomously moving on a surface to be cleaned, for example a floor, and collecting dust on the surface, and a station accumulating the dust collected by the autonomous robotic vacuum cleaning unit.

In this conventional electric vacuum cleaner, the autonomous robotic vacuum cleaning unit autonomously moves to a dust discharge position of the station such as base, allows the dust collected by the autonomous robotic vacuum cleaning unit to fall by its own weight and collects it into a dust container in the station.

PRIOR ART DOCUMENTS

Patent Document

Patent Document 1: Japanese Patent Laid-Open No. 2012-245344

SUMMARY

Problems to be Solved by the Invention

The electric vacuum cleaner that collects dust, which is collected by the autonomous robotic vacuum cleaning unit, into the station fails to disclose in terms of maintenance or cleaning of a dust container in the autonomous robotic vacuum cleaning unit. Specifically, The electric vacuum cleaner does not consider a detachable mechanism of the dust container in the autonomous robotic vacuum cleaning unit, and the dust container in the autonomous robotic vacuum cleaning unit is presumed to be integrated with the body case of the autonomous robotic vacuum cleaning unit, thus the electric vacuum cleaner cannot maintenance and cleaning of the dust container independently or separately.

Thus, maintenance and cleaning of the dust container is made easy by applying a detachable dust container to the autonomous robotic vacuum cleaning unit.

However, if the station accumulating the dust discharged from the dust container of the autonomous robotic vacuum cleaning unit is linked with the autonomous robotic vacuum cleaning unit which includes a detachable dust container, reliable prevention of leakage of the dust in a transfer passage that extends from the dust container of the autonomous robotic vacuum cleaning unit to the station is important.

To achieve the above object, an aspect of the present invention provides an electric vacuum cleaner that is able to effectively prevent leakage of dust in a transfer passage that extends from the dust container of the autonomous robotic vacuum cleaning unit to the station.

Means for Solving the Problems

To achieve the above object, an aspect of the present invention provides an electric vacuum cleaner including an autonomous robotic vacuum cleaning unit autonomously moving on a surface to be cleaned and collecting dust on the surface and a station including a charging electrode to charge the autonomous robotic vacuum cleaning unit. The autonomous robotic vacuum cleaning unit includes a body case, a primary dust container including a container body provided in the body case and accumulating dust collected by the autonomous robotic vacuum cleaning unit, a disposal port through which the dust in the container body is discharged, and a disposal lid for opening and closing the disposal port. The station includes a dust transfer pipe connected to the disposal port of the primary dust container, a lever hooked by the disposal lid while the autonomous robotic vacuum cleaning unit returns to the station, and opening the disposal lid so as to fluidically connect the disposal port and the dust transfer pipe to each other, and a secondary dust container for accumulating the dust discharged from the primary dust container through the dust transfer pipe.

It may be desired that the disposal port is opened downward of the autonomous robotic vacuum cleaning unit; and the dust transfer pipe is opened upward of the station.

It may be desired that the disposal port is arranged closer to the station than to a center of the autonomous robotic vacuum cleaning unit.

It may be desired that the connecting part is fitted with the dust container opening.

It may be desired that the connecting part is flush with an outer surface of the body case.

It may be desired that the disposal lid is flush with the outer surface of the body case.

DETAILED DESCRIPTION

An embodiment of an electric vacuum cleaner according to the present invention will be described by referring to FIGS. 1 to 12.

Figure 1:
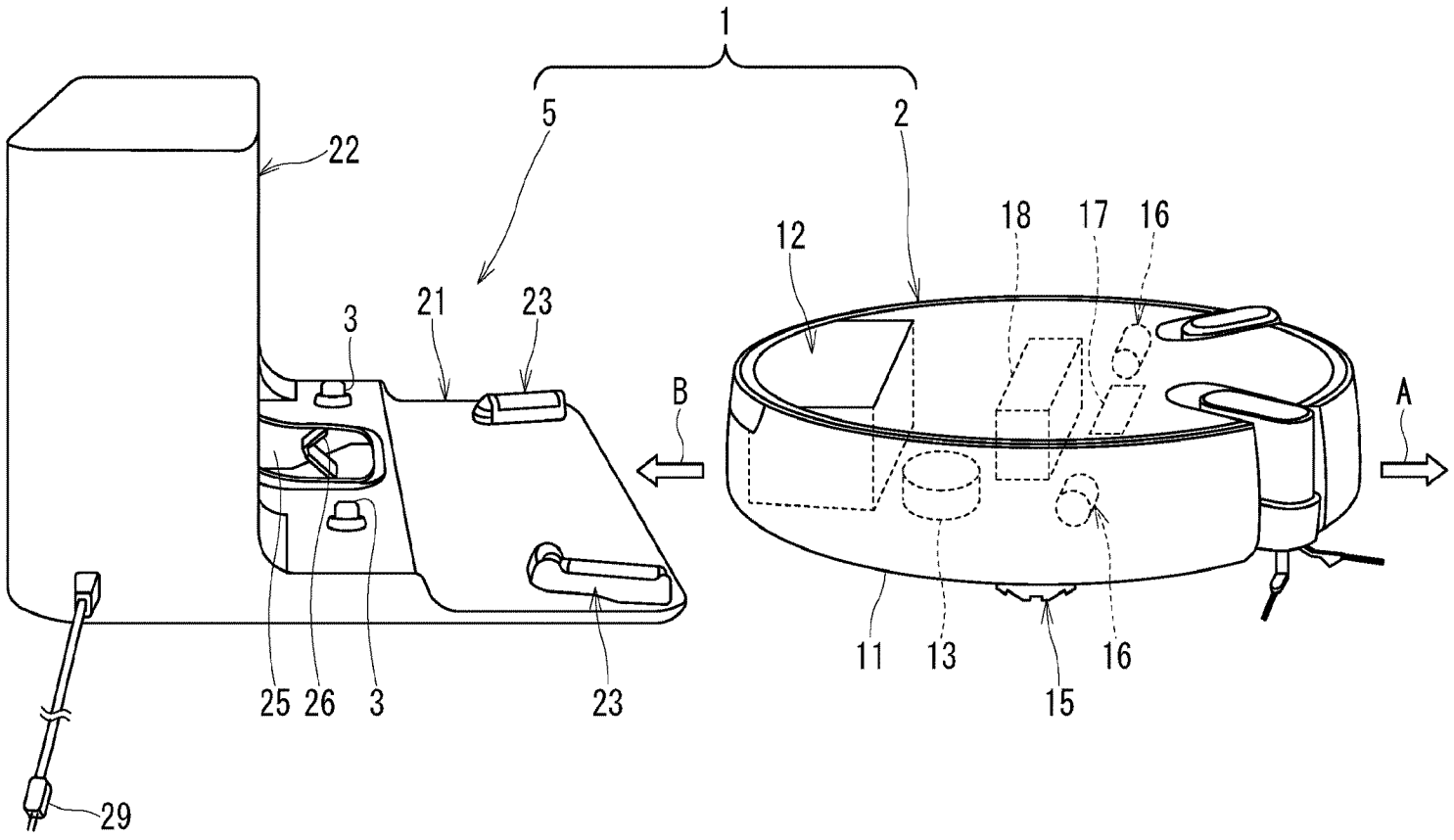
FIG. 1 is a perspective view illustrating an appearance of an electric vacuum cleaner according to an embodiment of the present invention.

FIG. 1 is a perspective view illustrating an appearance of the electric vacuum cleaner according to the embodiment of the present invention.

Figure 2:
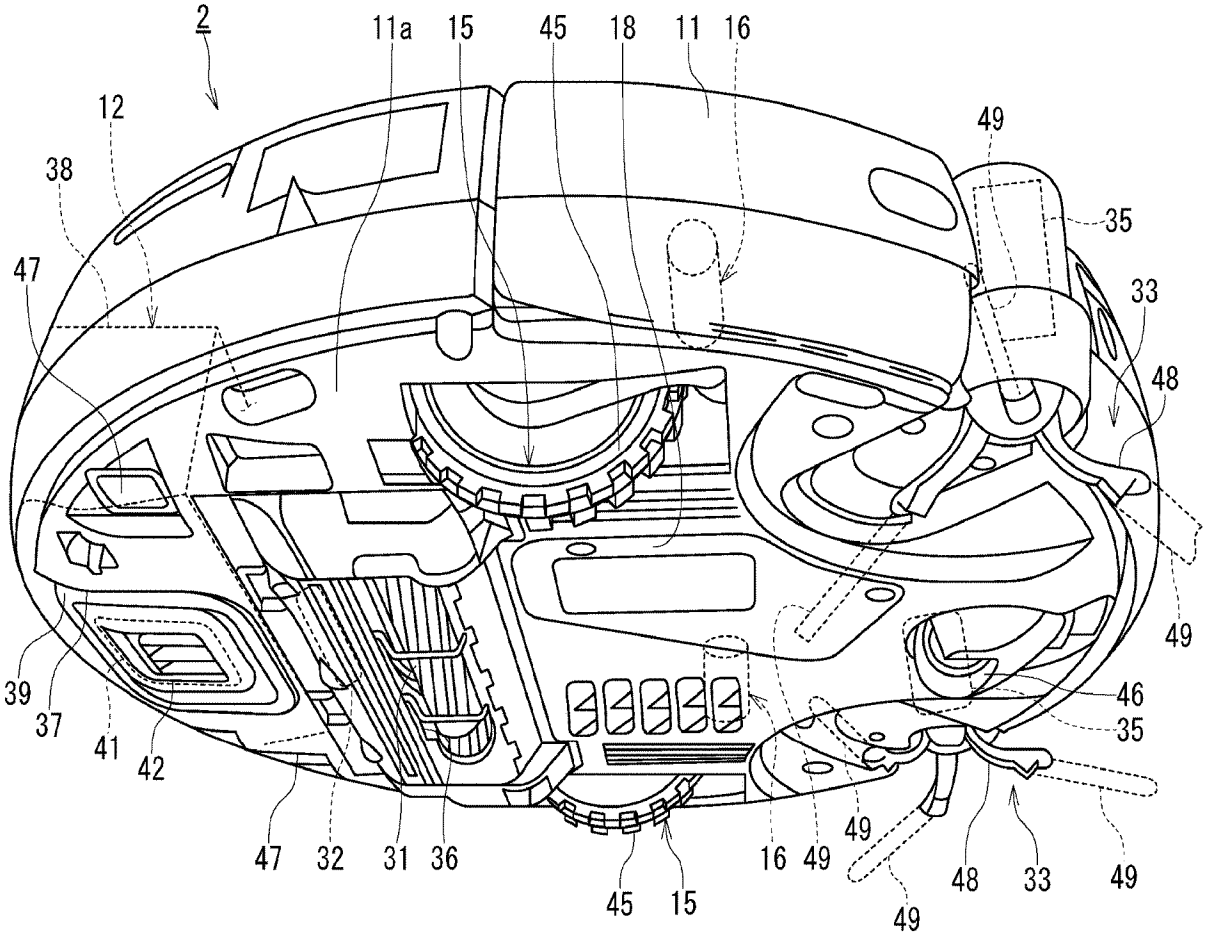
FIG. 2 is a perspective view illustrating a bottom face of the autonomous robotic vacuum cleaning unit of the electric vacuum cleaner according to the embodiment of the present invention.

As illustrated in FIGS. 1 and 2, an electric vacuum cleaner 1 according to the embodiment includes an autonomous robotic vacuum cleaning unit 2 autonomously moving on a surface to be cleaned, for example, a floor to collect dust on the surface and a station 5 including a charging electrode 3 to charge the autonomous robotic vacuum cleaning unit 2. In the electric vacuum cleaner 1, the autonomous robotic vacuum cleaning unit 2 autonomously moves over a whole area of the surface in a room to collect dust, and then returns to the station 5. The station 5 receives the dust collected by the autonomous robotic vacuum cleaning unit 2.

A position where the autonomous robotic vacuum cleaning unit 2 is electrically connected to the charging electrode 3 of the station 5 is a home position of the autonomous robotic vacuum cleaning unit 2 returning (homing) to the station 5. The autonomous robotic vacuum cleaning unit 2 returns to this home position when charging is required or when cleaning up the surface of the room is finished. The position where the autonomous robotic vacuum cleaning unit 2 is electrically connected to the charging electrode 3 of the station 5 is in a relative position between the autonomously moving autonomous robotic vacuum cleaning unit 2 and the station 5 which can be placed on an arbitrary place.

An arrow A in FIG. 1 indicates an advancing direction of the autonomous robotic vacuum cleaning unit 2, and an arrow B indicates a retreating direction of the autonomous robotic vacuum cleaning unit 2. A width direction of the autonomous robotic vacuum cleaning unit 2 is a direction orthogonal to the arrow A and the arrow B.

The autonomous robotic vacuum cleaning unit 2 advances to be separated from the station 5 and autonomously moves in the room, and retreats to be connected to the station 5 when returning to the station 5.

The autonomous robotic vacuum cleaning unit 2 is a so-called robot cleaner. The autonomous robotic vacuum cleaning unit 2 includes a body case 11 having a hollow disk shape, a primary dust container 12 detachably provided on a rear part of the body case 11, a primary electric blower 13 accommodated in the body case 11 and connected to the primary dust container 12, a moving section 15 to move the autonomous robotic vacuum cleaning unit 2 on the surface, a wheel driving section 16 to drive the moving section 15, a robot controller 17 to cause the body case 11 on the surface to autonomously move by controlling the wheel driving section 16, and a rechargeable battery 18 as a power supply.

The station 5 is placed on the surface. The station 5 includes a base 21 onto which the autonomous robotic vacuum cleaning unit 2 going homeward the position where it is electrically connected to the charging electrode 3 rides, a dust collecting section 22 integrated with the base 21, a roller pair 23 guiding the autonomous robotic vacuum cleaning unit 2 going toward the position where it is electrically connected to the charging electrode 3, a dust transfer pipe 25 connected to the primary dust container 12 of the autonomous robotic vacuum cleaning unit 2 in the position where the autonomous robotic vacuum cleaning unit 2 is electrically connected to the charging electrode 3, a lever 26 protruding from an inside of the dust transfer pipe 25, and a power cord 29 transmitting electric power from a commercial AC power supply.

Next, the autonomous robotic vacuum cleaning unit 2 according to the embodiment of the present invention will be described in detail.

FIG. 2 is a perspective view illustrating a bottom face of the autonomous robotic vacuum cleaning unit of the electric vacuum cleaner according to the embodiment of the present invention.

As illustrated in FIG. 2, the autonomous robotic vacuum cleaning unit 2 of the electric vacuum cleaner 1 according to the embodiment of the present invention includes a center brush 31 provided on a bottom face 11*a* of the body case 11, a center brush driving section 32 driving the center brush 31, a pair of right and left side brushes 33 provided on the bottom face 11*a* of the body case 11, and side brush driving sections 35 driving each of the side brushes 33.

The body case 11 having a disk shape is made of a synthetic resin, for example, and easily rotates on the surface. A laterally long suction port 36 is provided at a center part in the width direction of a rear half of the bottom face 11*a*.

A width dimension of the suction port 36 is approximately two thirds of a width dimension, that is, a diameter dimension of the body case 11. The suction port 36 is fluidically connected to the primary electric blower 13 via the primary dust container 12.

The body case 11 has a dust container opening 37 on the bottom face 11*a*. The dust container opening 37 is arranged on a portion covering a lower part of the primary dust container 12. The dust container opening 37 has a rectangular shape with rounded corners and exposes a part of the primary dust container 12 attached to the body case 11.

The primary dust container 12 accumulates dust suctioned through the suction port 36 by a suction negative pressure generated by the primary electric blower 13. A filter filtering and collecting the dust, a separation device separating the dust by inertia separation, for example, centrifugal separation and separation by inertia force in a straight advance direction is applied to the primary dust container 12. The primary dust container 12 is arranged on the rear part of the body case 11. The primary dust container 12 includes a container body 38 detachably provided on the body case 11 to accumulate the dust collected by the autonomous robotic vacuum cleaning unit 2, a connecting part 39 exposed from the dust container opening 37 in a state where it is attached to the body case 11, a disposal port 41 provided on the connecting part 39 and discharging the dust in the container body 38, and a disposal lid 42 for opening and closing the disposal port 41.

The moving section 15 includes a pair of right and left driving wheels 45 arranged on the bottom face 11*a* of the body case 11, and a turning wheel 46 such as a caster arranged on the bottom face 11*a* of the body case 11.

The driving wheels 45 protrude from the bottom face 11*a* of the body case 11 and are grounded on the surface in a state where the autonomous robotic vacuum cleaning unit 2 is placed on the surface. The driving wheels 45 are arranged substantially at the center part in a longitudinal direction of the body case 11, and are arranged closer to each of right and left side parts of the body case 11, avoiding a front of the suction port 36. Axles of the driving wheels 45 align in the width direction of the body case 11. The autonomous robotic vacuum cleaning unit 2 advances or retreats by rotating the right and left driving wheels 45 in the same direction. and turns to right or to left by rotating the right and left driving wheels 45 in directions opposite to each other.

The turning wheel 46 is a turnable driven wheel. It is arranged substantially on a front part and at the center part in the width direction of the body case 11.

The wheel driving section 16 includes a pair of motors, each connected to the corresponding driving wheels 45. The wheel driving section 16 independently drives each of the right and left driving wheels 45.

The robot controller 17 includes a microprocessor (not shown) and a storage device (not shown) storing various calculation programs executed by the microprocessor, parameters, for example. The robot controller 17 is electrically connected to the primary electric blower 13, the center brush driving section 32, the wheel driving section 16, and the side brush driving section 35.

The rechargeable battery 18 is a power source for the primary electric blower 13, the center brush driving section 32, the wheel driving section 16, the side brush driving section 35, and the robot controller 17. The rechargeable battery 18 is arranged between the turning wheel 46 and the suction port 36, for example. The rechargeable battery 18 is electrically connected to a pair of charging terminals 47 arranged on the bottom face 11*a* of the body case 11. The rechargeable battery 18 is charged when connection of the charging terminals 47 is connected to the charging electrode 3 of the station 5.

The center brush 31 is provided in the suction port 36. The center brush 31 is a shaft-shaped brush rotatable around a rotation center line extending in the width direction of the body case 11. The center brush 31 may include a lengthy shaft section and a plurality of brushes extending in a radial direction of the shaft section and aligned spirally in a longitudinal direction of the shaft section. The center brush 31 protrudes from the suction port 36 lower than the bottom face 11*a* of the body case 11 and causes the brush to contact with the surface in a state where the autonomous robotic vacuum cleaning unit 2 is placed on the surface.

The center brush driving sections 32 are accommodated in the body case 11.

The side brushes 33 are auxiliary cleaning bodies, each arranged on the corresponding right and left sides with respect to the advancing direction of the center brush 31, and sweeping and gathering the dust on the surface beside a wall, which the center brush 31 cannot reach, to the suction port 36. Each of the side brushes 33 includes a brush base section 48 having a rotation center slightly tilted forward with respect to a vertical line of the surface and three pieces of, for example, linear cleaning bodies 49 radially protruding toward a radial direction of the brush base section 48.

The right and left brush base sections 48 are arranged on the front of the suction port 36 and the right and left driving wheels 45 and in the rear of the turning wheel 46 and closer to the corresponding right and left sides of the body case 11 than to the suction port 36. The rotation center line of each of the brush base sections 48 is slightly tilted forward with respect to the vertical line of the surface. Thus, the linear cleaning body 49 turns along a plane tilted forward with respect to the surface (floor). When the linear cleaning body 49 turns around by itself and a distal end of the linear cleaning body 49 comes in front of the brush base section 48, the distal end is pressed the most firmly onto the surface, whereas the distal end of the linear cleaning body 49 is farthest from the surface when it comes to right behind of the brush base section 48.

The plurality of linear cleaning bodies 49 are arranged radially from the brush base section 48, that is, to three directions, for example, at equal intervals. The side brush 33 may include four or more linear cleaning bodies 49 for the corresponding brush base sections 48. Each of the linear cleaning bodies 49 includes a plurality of brush bristles as cleaning members on the distal end. The brush bristles turn drawing a trajectory expanded outward from an outer peripheral edge of the body case 11.

Each of the side brush driving sections 35 includes a rotating shaft protruding downward to be connected to the brush base section 48 of the side brush 33. Each of the side brush driving sections 35 rotates the side brush 33 so as to sweep the dust on the surface to the suction port 36.

Next, the station 5 according to the embodiment of the present invention will be described in detail.

Figure 3:
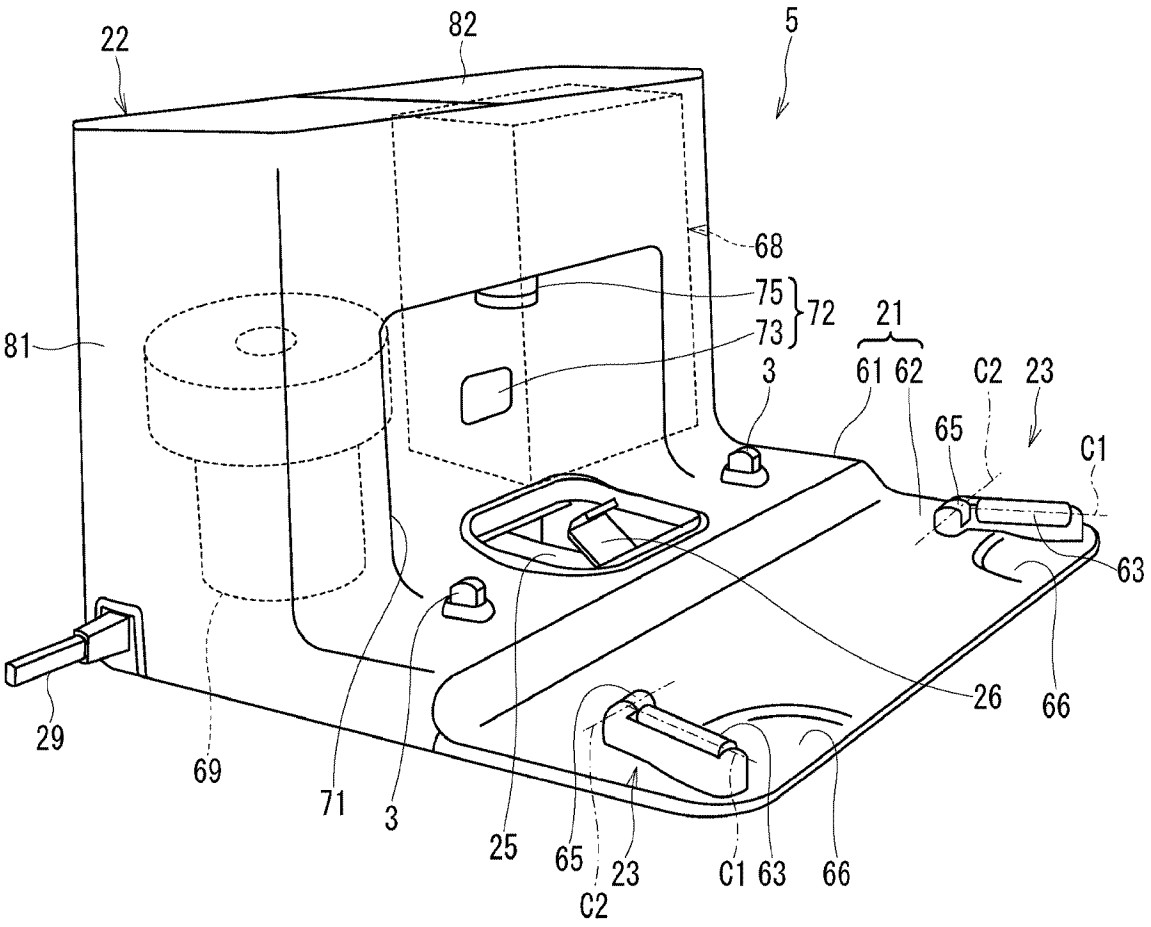
FIG. 3 is a perspective view illustrating a station of the electric vacuum cleaner according to the embodiment of the present invention.

FIG. 3 is a perspective view illustrating the station of the electric vacuum cleaner according to the embodiment of the present invention.

As illustrated in FIG. 3, the base 21 of the station 5 according to the embodiment extends to a front side of the station 5 and expands having a rectangular shape. The base 21 includes a high floor section 61 consecutively connected to a bottom part of the dust collecting section 22 and a low floor section 62 extending from the high floor section 61. The low floor section 62 and the high floor section 61 extend having a band shape in a width direction of the station 5. The roller pair 23 is arranged on the low floor section 62. The charging electrode 3 and an inlet of the dust transfer pipe 25 are arranged on the high floor section 61.

The autonomous robotic vacuum cleaning unit 2 arrives at the home position with the driving wheels 45 to riding onto the low floor section 62 and an attitude having the primary dust container 12 arranged above the high floor section 61.

The roller pair 23 is arranged on each of right and left end portions and on a front end portion of the low floor section 62 of the base 21.

The roller pair 23 includes a pair of cross direction rollers 63 guiding the autonomous robotic vacuum cleaning unit 2 in a direction of crossing a direction (homing direction) toward the position where the autonomous robotic vacuum cleaning unit 2 is electrically connected to the charging electrode 3, that is, in the width direction and a pair of stopper rollers 65 idling the driving wheels 45 when the autonomous robotic vacuum cleaning unit 2 has arrived at the position where it is electrically connected to the charging electrode 3. The roller pair 23, that is, the cross direction rollers 63 and the stopper rollers 65 protrudes from the base 21 as the grounding plane for the driving wheels 45.

The cross direction rollers 63 have non-parallel rotation centers C1 whose inter-shaft distance narrows toward the position where the autonomous robotic vacuum cleaning unit 2 is electrically connected to the charging electrode 3. The cross section rollers 63 have the rotation centers C1 which get closer to each other as they get closer to the dust collecting section 22 from a front end of the base 21.

The stopper rollers 65 have rotation centers C2 crossing in the direction of the position where the autonomous robotic vacuum cleaning unit 2 is electrically connected to the charging electrode 3. The stopper rollers 65 prevent the autonomous robotic vacuum cleaning unit 2 advancing (retreating) by idling each of the driving wheels 45 when the autonomous robotic vacuum cleaning unit 2 has arrived at the position where it is electrically connected to the charging electrode 3. The rotation centers C2 of the stopper rollers 65 are preferably orthogonal in the direction toward the position where the autonomous robotic vacuum cleaning unit 2 is electrically connected to the charging electrode 3.

The base 21 includes running surfaces 66 having a projection-and-recess shape for decreasing a grounding area of each of the driving wheels 45 when the autonomous robotic vacuum cleaning unit 2 goes toward the position where the autonomous robotic vacuum cleaning unit 2 is electrically connected to the charging electrode 3. The running surfaces 66 are provided on the area surrounded by the roller pair 23, that is, the cross direction rollers 63 and the stopper rollers 65. The running surfaces 66 are a plurality of linear projections and recesses, lattice-shaped projections and recesses or a plurality of semispherical projections and recesses provided on a part of the base 21.

The dust collecting section 22 includes a secondary dust container 68 accumulating the dust discharged from the primary dust container 12 through the dust transfer pipe 25, a secondary electric blower 69 accommodated in the dust collecting section 22 and connected to the secondary dust container 68, and a power cord 29 transmitting electric power from the commercial AC power supply to the secondary electric blower 69 and the charging electrode 3.

The dust collecting section 22 is a box body having a rounded corner rectangular shape, arranged on a rear part of the station 5, and extending upward the base 21. A front wall of the dust collecting section 22 includes an arc-shaped recessed section 71 corresponding to a rear end portion of the autonomous robotic vacuum cleaning unit 2. An inlet of the dust transfer pipe 25 extends from the high floor section 61 of the base 21 to the recessed section 71. In the recessed section 71, a homing detector 72 is provided for detecting whether or not the autonomous robotic vacuum cleaning unit 2 has arrived at the position where the autonomous robotic vacuum cleaning unit 2 is electrically connected to the charging electrode 3. The homing detector 72 is a so-called object sensor (proximity sensor) detecting a relative distance from the autonomous robotic vacuum cleaning unit 2 by using visible light or infrared rays. The homing detector 72 includes a first sensor 73 detecting the relative distance from the autonomous robotic vacuum cleaning unit 2 in a front direction of the dust collecting section 22 and a second sensor 75 detecting the relative distance from the autonomous robotic vacuum cleaning unit 2 in a height direction of the dust collecting section 22.

The dust collecting section 22 includes a lid 82 covering the secondary dust container 68 accommodated in a body 81. The lid 82 opens or closes a part of, that is, a right half of a ceiling of the dust collecting section 22. The second dust container 68 is arranged below the lid 82.

The charging electrodes 3 are arranged so as to place the inlet of the dust transfer pipe 25 there between. Each of the charging electrodes 3 is arranged on a front of the corresponding right and left edges of the recessed section 71.

Figure 4:
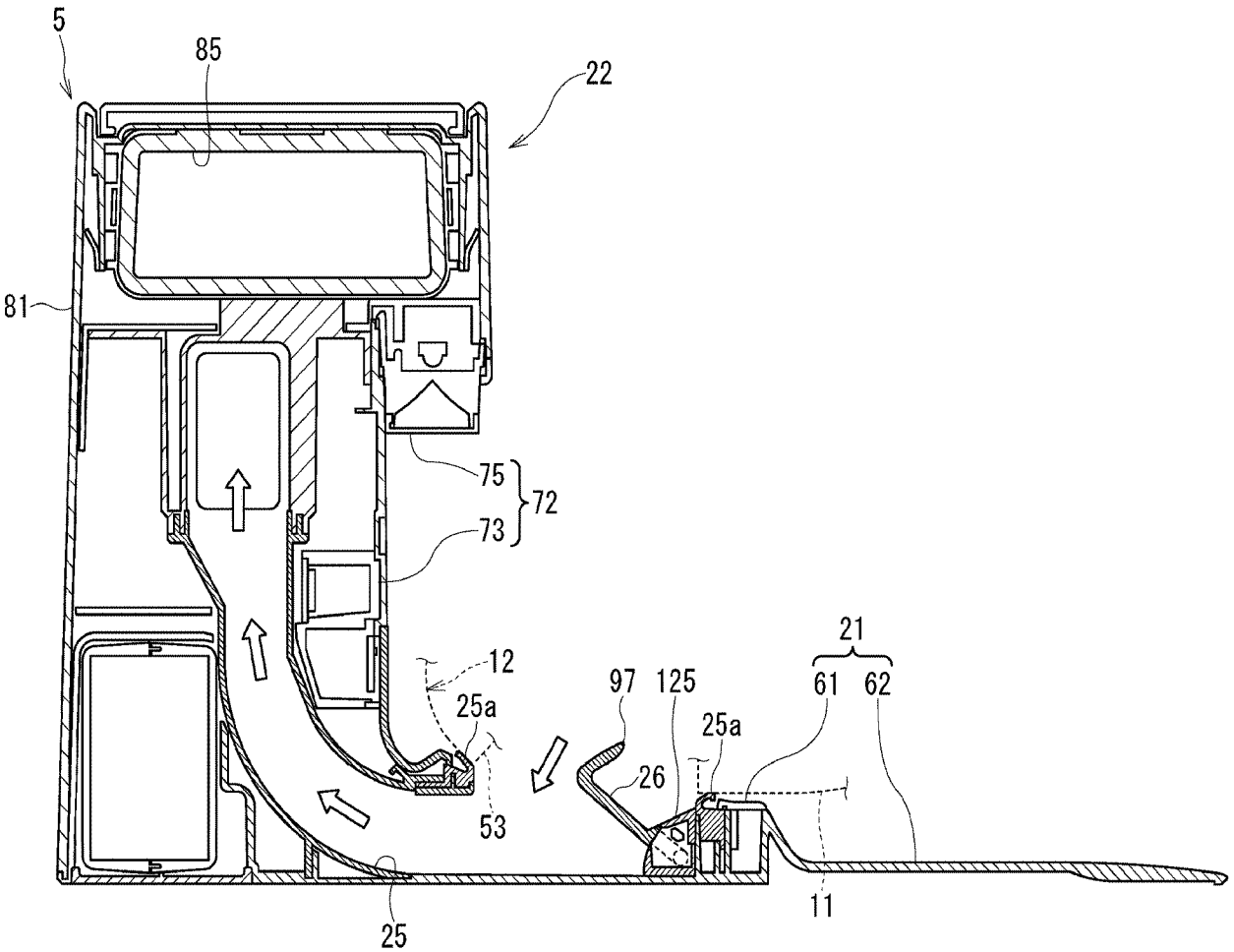
FIG. 4 is a longitudinal section illustrating the station of the electric vacuum cleaner according to the embodiment of the present invention.

FIG. 4 is a longitudinal section illustrating the station of the electric vacuum cleaner according to the embodiment of the present invention.

Figure 5:
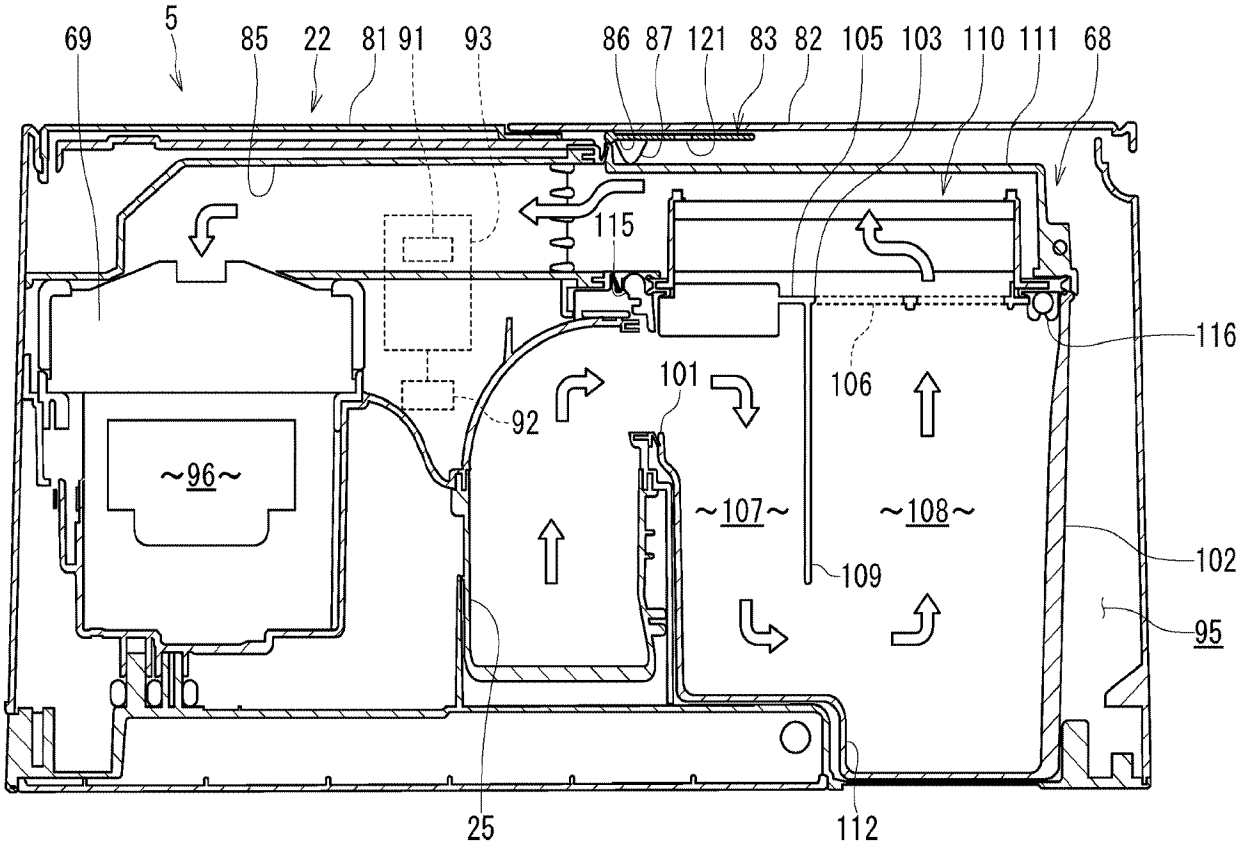
FIG. 5 is a cross section illustrating the station of the electric vacuum cleaner according to the embodiment of the present invention.

FIG. 5 is a cross section illustrating the station of the electric vacuum cleaner according to the embodiment of the present invention.

As illustrated in FIGS. 4 and 5, the dust collecting section 22 of the station 5 according to the embodiment of the present invention includes the body 81 having the dust transfer pipe 25 as an air passage guiding the dust, the secondary dust container 68 detachably accommodated in the body 81, and detachably connected to the dust transfer pipe 25, the secondary electric blower 69 generating a suction negative pressure in the dust transfer pipe 25 through the second dust container 68, the lid 82 covering the secondary dust container 68 accommodated in the body 81, an erroneous suction preventing section 83 provided on the lid 82 and blocking the air passage on a suction side of the secondary electric blower 69 when the secondary dust container 68 is detached from the body 81, and a downstream pipe 85 fluidically connecting the secondary dust container 68 and the secondary electric blower 69.

The dust collecting section 22 includes a claw 87 provided on the erroneous suction preventing section 83 and directing a sealing surface 86, which blocks the air passage on the suction side of the secondary electric blower 69, toward the secondary dust container 68 by regulating a swing angle of the erroneous suction preventing section 83 when the lid 82 contacts with the secondary dust container 68 while it is closing.

The dust collecting section 22 includes a pressure detecting section 91 detecting the suction negative pressure of the secondary electric blower 69, an alarm section 92 informing that the dust accumulated in the secondary dust container 68 has reached a pre-determined amount, and a control section 93 causing the alarm section 92 to operate when a detection result of the pressure detecting section 91 becomes a pressure lower than a pre-determined suction negative pressure.

The body 81 is shorter in a depth direction (direction to which the autonomous robotic vacuum cleaning unit 2 retreats when homing) and longer in a width direction. The body 81 has a dust container chamber 95 accommodating the secondary dust container 68 in one of halves in the width direction, for example, in a right-side half and a blower chamber 96 accommodating the secondary electric blower 69 in another of the halves in the width direction, for example, in a left-side half.

The dust transfer pipe 25 is air-tightly connected to the disposal port 41 while being in contact with the connecting part 39 of the primary dust container 12 in the position where the autonomous robotic vacuum cleaning unit 2 is electrically connected to the charging electrode 3. An annular sealing member 25*a* is provided on an opening, that is, an inlet edge of the dust transfer pipe 25. The sealing member 25*a* is brought into close contact with the connecting part 39 in the position where the autonomous robotic vacuum cleaning unit 2 is electrically connected to the charging electrode 3. The dust transfer pipe 25 extends rearward from the inlet arranged in the high floor section 61 of the base 21 to reach an inside of the dust collecting section 22, extends upward between the dust container chamber 95 and the blower chamber 96 with lastly being bent within the dust collecting section 22 and reaches a side of the secondary dust container 68. The dust transfer pipe 25 has the inlet open upward of the station 5 and an outlet open sideward of the secondary dust container 68.

The lever 26 arranged at the inlet of the dust transfer pipe 25 includes a hook 97 extending frontward direction and also extending upward of the dust collecting section 22.

The secondary dust container 68 has an opening at a ceiling and includes a dust container 102 having a suction port 101 on a side face, a lid 105 closing the ceiling of the dust container 102, the lid 105 having a discharge port 103, a net filter 106 provided at the discharge port 103, a partition plate 109 suspended toward a bottom of the dust container 102 from the lid 105 and partitioning an inside of the dust container 102 into an upstream space 107 directly connected to the suction port 101 and a downstream space 108 connected to the discharge port 103 and connecting the upstream space 107 and the downstream space 108 on a bottom part in the dust container 102, a secondary filter 110 connected to the discharge port 103 and covering a part above the lid 105, and a cover pipe 111 defining a downstream side air passage of the secondary filter 110.

The dust container 102 includes a protruding section 112 arranged below the downstream space 108 and protruding downward from a bottom part of the upstream space 107.

The secondary filter 110 is connected to the downstream pipe 85.

The secondary dust container 68 includes a first hinge mechanism 115 integrally opening and closing the lid 105, the partition plate 109, and the secondary filter 110 and a second hinge mechanism 116 opening and closing a passage on a filtering surface side (upstream side) of the secondary filter 110 by causing the lid 105 and the partition plate 109 to integrally swing.

The cover pipe 111 also functions as an air passage connecting the downstream air passage of the secondary filter 110 to the downstream pipe 85. The cover pipe 111 is swingably supported by the first hinge mechanism 115 together with the lid 105.

The first hinge mechanism 115 is arranged above the suction port 101 and on an upper end portion of a side wall of the dust container 102 having the suction port 101.

The second hinge mechanism 116 is provided on an end portion across the lid 105 from the first hinge mechanism 115.

The secondary electric blower 69 is accommodated with its suction port directed upward in the blower chamber 96 of the body 81.

The downstream pipe 85 is an air passage on the suction side of the secondary electric blower 69 and is arranged above the dust transfer pipe 25 and extends in the width direction of the body 81 in the dust collecting section 22. An inlet of the downstream pipe 85 is open in the dust container chamber 95. An outlet of the downstream pipe 85 is connected to the suction port of the secondary electric blower 69. The downstream pipe 85 is connected to a downstream side of the secondary filter 110 of the secondary dust container 68 when the secondary dust container 68 is contained in the dust container chamber 95.

The lid 82 is swingably provided on the body 81. The lid 82 opens and closes an opening of the ceiling of the dust container chamber 95 containing the secondary dust container 68.

The erroneous suction preventing section 83 is swingably provided on the lid 82. The erroneous suction preventing section 83 has a ventilation hole 121 avoiding the air passage on the suction side of the second electric blower 69 from being fully closed.

When the autonomous robotic vacuum cleaning unit 2 returns to the home position, the charging terminal 47 of the autonomous robotic vacuum cleaning unit 2 is electrically connected to the charging electrode 3 of the station 5. Meanwhile, the dust transfer pipe 25 of the station 5 is connected to the connecting part 39 of the primary dust container 12. And then, the station 5 starts the secondary electric blower 69 to suction air in the direction of a solid arrow in FIGS. 4 and 5 and to move the dust from the primary dust container 12 to the secondary dust container 68. The secondary dust container 68 collects coarse dust with the net filter 106 and accumulates it in the downstream space 108. The dust collected by the net filter 106 is accumulated so as to be stacked from an upper side to a lower side of the downstream space 108. The dust collected by the net filter 106 is compressed so as to be pressed onto the net filter 106 due to an air flow. The compressed coarse dust functions as a fine filter and collects fine dust contained in the air. A part of the fine dust collected by the compressed coarse dust is entangled by the coarse dust, while others are removed from the coarse dust and reach the bottom of below the downstream space 108. The protruding section 112 below the downstream space 108, and the fine dust removed from the coarse dust falls and piles up on the protruding section 112. In the protruding section 112, the air flowing in a U-shape from the upstream space 107 to the downstream space 108 in the secondary dust container 68 can easily stagnate. Thus, the fine dust falling and piling up on the protruding section 112 is not blown up by the air flow in the secondary dust container 68 but easily remains in the protruding section 112.

The fine dust passing through the net filter 106 and the fine dust passing through the compressed coarse dust is caught with the secondary filter 110.

FIGS. 6 to 16 are longitudinal sectional views illustrating a connection portion between the autonomous robotic vacuum cleaning unit and the station of the electric vacuum cleaner according to the embodiment of the present invention.

Figure 6:
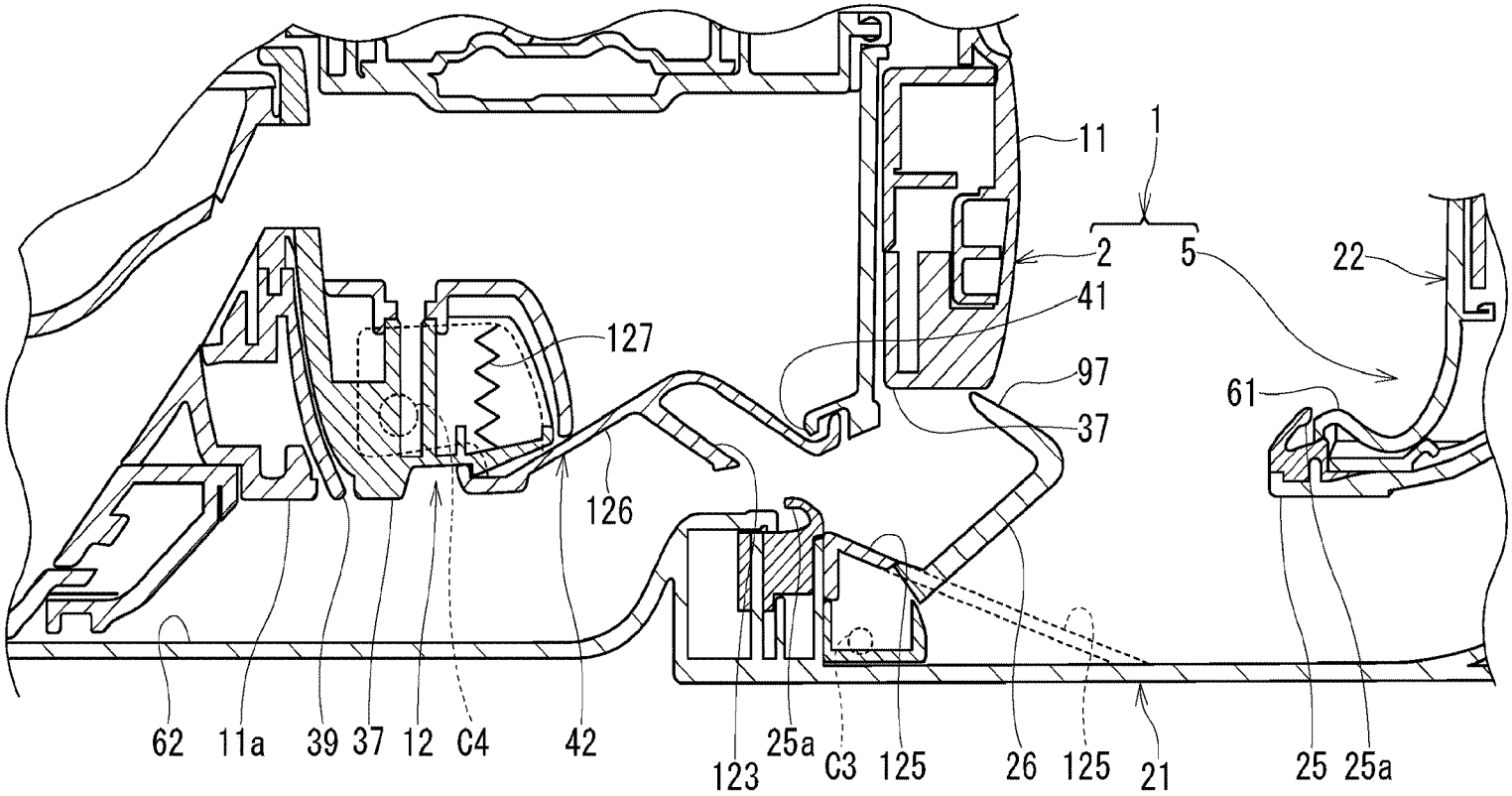
FIG. 6 is a longitudinal sectional view illustrating a connecting part of the autonomous robotic vacuum cleaning unit and the station of the electric vacuum cleaner according to the embodiment of the present invention.
Figure 7:
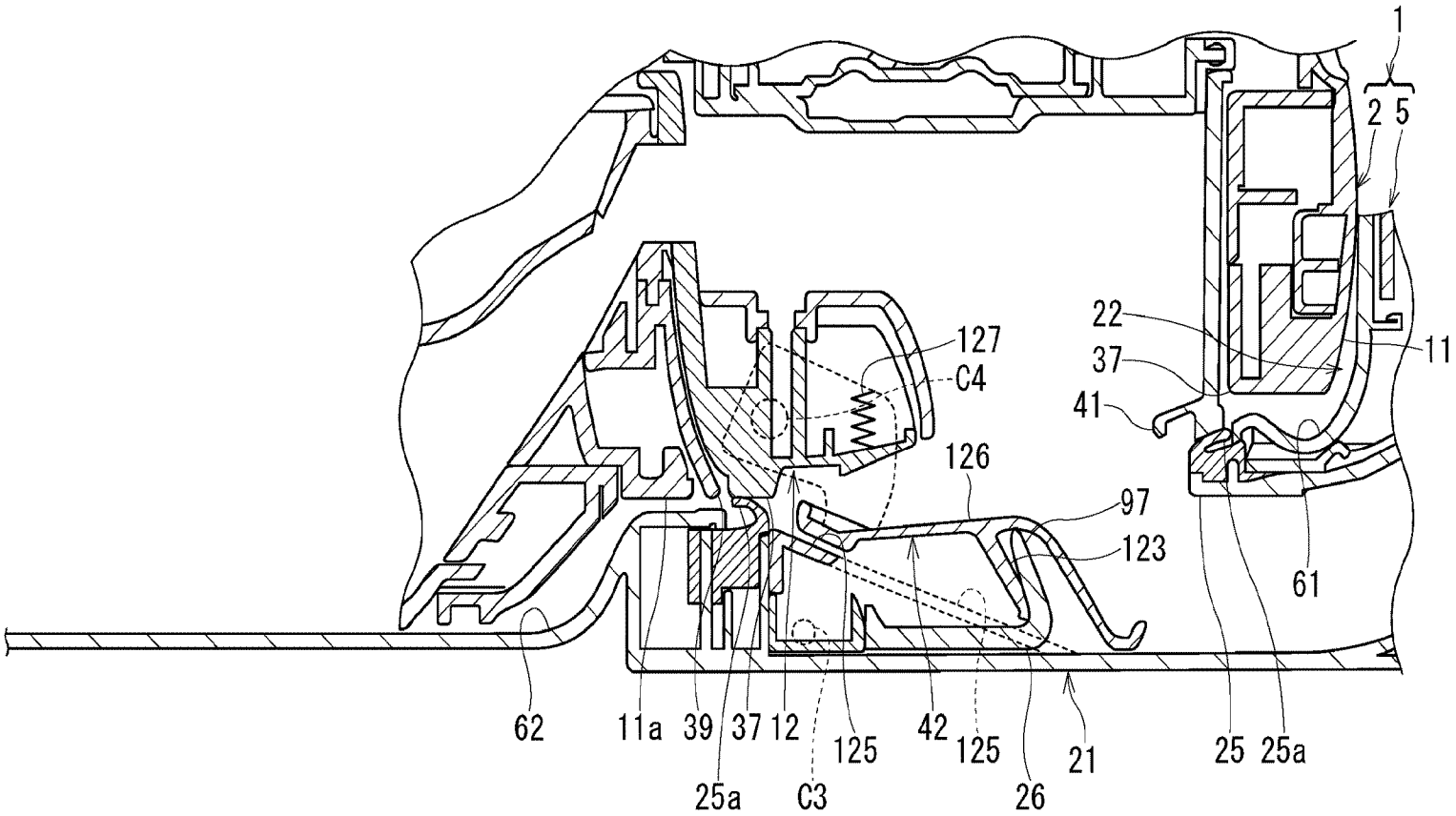
FIG. 7 is the longitudinal sectional view illustrating a connecting part of the autonomous robotic vacuum cleaning unit and the station of the electric vacuum cleaner according to the embodiment of the present invention.

FIGS. 6 and 7 illustrate how the autonomous robotic vacuum cleaning unit 2 is getting closer to the position, that is, the home position where it is electrically connected to the charging electrode 3 step by step. When the autonomous robotic vacuum cleaning unit 2 is getting away from the station 5, the order goes in the opposite direction from FIG. 16 to FIG. 6.

As illustrated in FIGS. 6 to 16, the primary dust container 12 of the autonomous robotic vacuum cleaning unit 2 according to the embodiment includes the container body 38 detachably provided in the body case 11 and accumulating the dust collected by the autonomous robotic vacuum cleaning unit 2, the connecting part 39 exposed from the dust container opening 37 in the state where it is attached to the body case 11, the disposal port 41 provided on the connecting part 39 for disposing of the dust in the container body 38, and the disposal lid 42 for opening and closing the disposal port 41.

The connecting part 39 is integrally molded on the container body 38. The connecting part 39 protrudes having a rounded corner rectangular shape to correspond to the dust container opening 37. When the primary dust container 12 is attached to the body case 11, the connecting part 39 is fitted with the dust container opening 37. The connecting part 39 has an outer peripheral edge portion flush with an outer surface of the body case 11 and a recessed section on a peripheral edge portion of the disposal port 41. The disposal port 41 is arranged at a center of this recessed section. The disposal lid 42 is arranged on the recessed section.

The connecting part 39 may be arranged at a place facing the dust container opening 37 in the state where the primary dust container 12 is attached to the body case 11. In this case, the connecting part 39 is arranged at a place inside the body case 11, and can be seen through from the dust container opening 37. The dust transfer pipe 25 preferably has a protruding length capable of reaching the connecting part 39 through the dust container opening 37.

The disposal port 41 is opened downward of the autonomous robotic vacuum cleaning unit 2 in the state where the primary dust container 12 is attached to the body case 11.

The disposal port 41 is arranged closer to the station 5 than to the center of the autonomous robotic vacuum cleaning unit 2 in the position where the autonomous robotic vacuum cleaning unit 2 is electrically connected to the charging electrode 3. That is, the disposal port 41 gets closer to the dust collecting section 22 of the station 5 when the autonomous robotic vacuum cleaning unit 2 retreats and gets closer to the station 5 and the driving wheels 45 ride onto the base 21 of the station 5.

The disposal lid 42 is exposed on an appearance of the autonomous robotic vacuum cleaning unit 2 and is flush with the external surface of the body case 11. The disposal lid 42 includes a lever receiver 123 by which the lever 26 of the station 5 is hooked. The disposal lid 42 may also be arranged at a place facing the dust container opening 37 in the state where the disposal lid 42 is attached to the body case 11 similarly to the connecting part 39. In this case, the disposal lid 42 is arranged inside the body case 11, and can be seen through from the dust container opening 37.

The lever 26 of the station 5 according to the embodiment is hooked by the disposal lid 42 of the autonomous robotic vacuum cleaning unit 2 while going toward the position where the autonomous robotic vacuum cleaning unit 2 is electrically connected to the charging electrode 3 and opens the disposal lid 42 when reaching the position where the autonomous robotic vacuum cleaning unit 2 is electrically connected to the charging electrode 3 so as to fluidically connect the disposal port 41 and the dust transfer pipe 25 to each other (FIG. 7).

The disposal lid 42 of the autonomous robotic vacuum cleaning unit 2 and the lever 26 of the station 5 swing around a rotation center line C3 crossing in the direction toward the position where the autonomous robotic vacuum cleaning unit 2 is electrically connected to the charging electrode 3. A rotation center C4 of the disposal lid 42 and the rotation center line C3 of the lever 26 are preferably orthogonal in the direction toward the position where the autonomous robotic vacuum cleaning unit 2 is electrically connected to the charging electrode 3.

The rotation center line C3 of the lever 26 is arranged on an edge portion in the opening edge portion of the dust transfer pipe 25, that is, a front end portion of the opening edge of the dust transfer pipe 25, where the autonomous robotic vacuum cleaning unit 2 first reaches in the direction toward the position where the autonomous robotic vacuum cleaning unit 2 is electrically connected to the charging electrode 3.

The rotation center line C3 of the lever 26 is supported movably in the direction toward the position where the autonomous robotic vacuum cleaning unit 2 is electrically connected to the charging electrode 3. That is, the rotation center line C3 of the lever 26 can allow the hook 97 to be hooked by the lever receiver 123 by moving in the direction toward the position where the autonomous robotic vacuum cleaning unit 2 is electrically connected to the charging electrode 3, without being affected by fluctuation of positional accuracy in return control (homing control) of the autonomous robotic vacuum cleaning unit 2.

The rotation center line C3 of the lever 26 is covered with a shaft cover 125 provided on the edge portion in the opening edge portion of the dust transfer pipe 25, that is, the front end portion of the opening edge of the dust transfer pipe 25, where the autonomous robotic vacuum cleaning unit 2 first reaches in the direction toward the position where the autonomous robotic vacuum cleaning unit 2 is electrically connected to the charging electrode 3.

The rotation center line C4 of the disposal lid 42 is arranged on a behind of the disposal lid 42 in the direction toward the position where the autonomous robotic vacuum cleaning unit 2 is electrically connected to the charging electrode 3. The rotation center line C4 of the disposal lid 42 is arranged further than the lever receiver 123 in the direction toward the position where the autonomous robotic vacuum cleaning unit 2 is electrically connected to the charging electrode 3. The rotation center line C4 of the disposal lid 42 is arranged further than a lid body 126 contacting with or separating from the disposal port 41 in the disposal lid 42 in the direction toward the position where the autonomous robotic vacuum cleaning unit 2 is electrically connected to the charging electrode 3.

The disposal lid 42 makes an inclined surface guiding the dust from the container body 38 of the autonomous robotic vacuum cleaning unit 2 to the dust transfer pipe 25 when it is opened by the lever 26 due to arrangement of the rotation center line C3 of the lever 26 and the rotation center line C4 of the disposal lid 42 (FIG. 7).

A spring force of a coil spring 127 enables the disposal lid 42 to be closed. The disposal lid 42 is opened when a propulsive force toward the position where the autonomous robotic vacuum cleaning unit 2 is electrically connected to the charging electrode 3 overcomes the spring force of the coil spring 127. When the disposal lid 42 is opened by the lever 26, the coil spring 127 is compressed to store spring energy, while when the autonomous robotic vacuum cleaning unit 2 leaves the station 5 and the lever 26 is released from the lever receiver 123, spring energy is released from the coil spring 127 and the disposal lid 42 is closed.

A spring force of a coil spring (not shown) is applied to the lever in the direction where it is raised up. The lever 26 is fallen down when the propulsive force toward the position where the autonomous robotic vacuum cleaning unit 2 is electrically connected to the charging electrode 3 overcomes the spring force of the coil spring. When the disposal lid 42 is opened by the lever 26, the coil spring is compressed to store spring energy, while when the autonomous robotic vacuum cleaning unit 2 separates from the station 5 and the lever 26 is released from the lever receiver 123, spring energy is released and the lever 26 is stood up.

Figure 8:
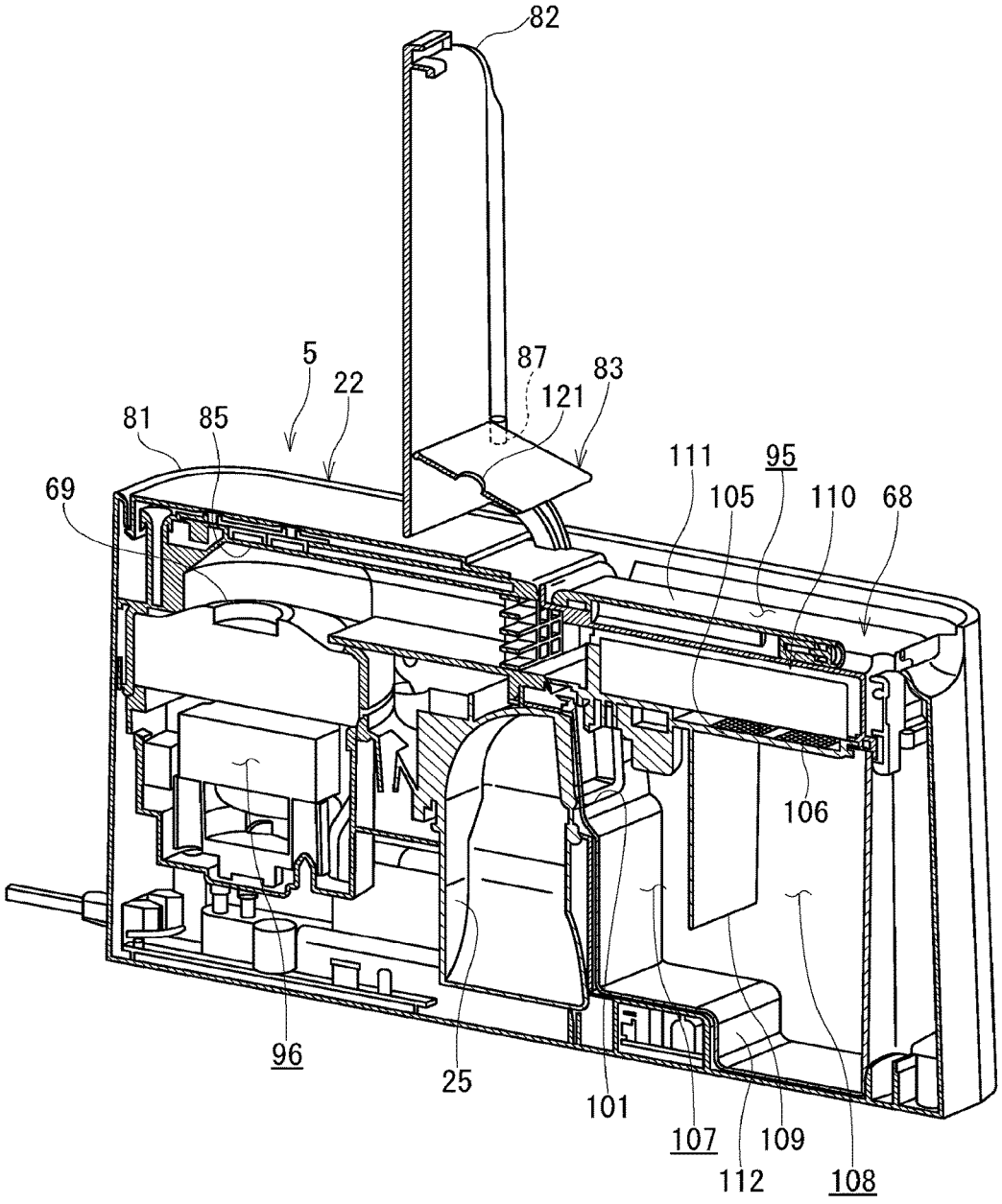
FIG. 8 is a cross sectional perspective view illustrating the station of the electric vacuum cleaner according to the embodiment of the present invention.
Figure 9:
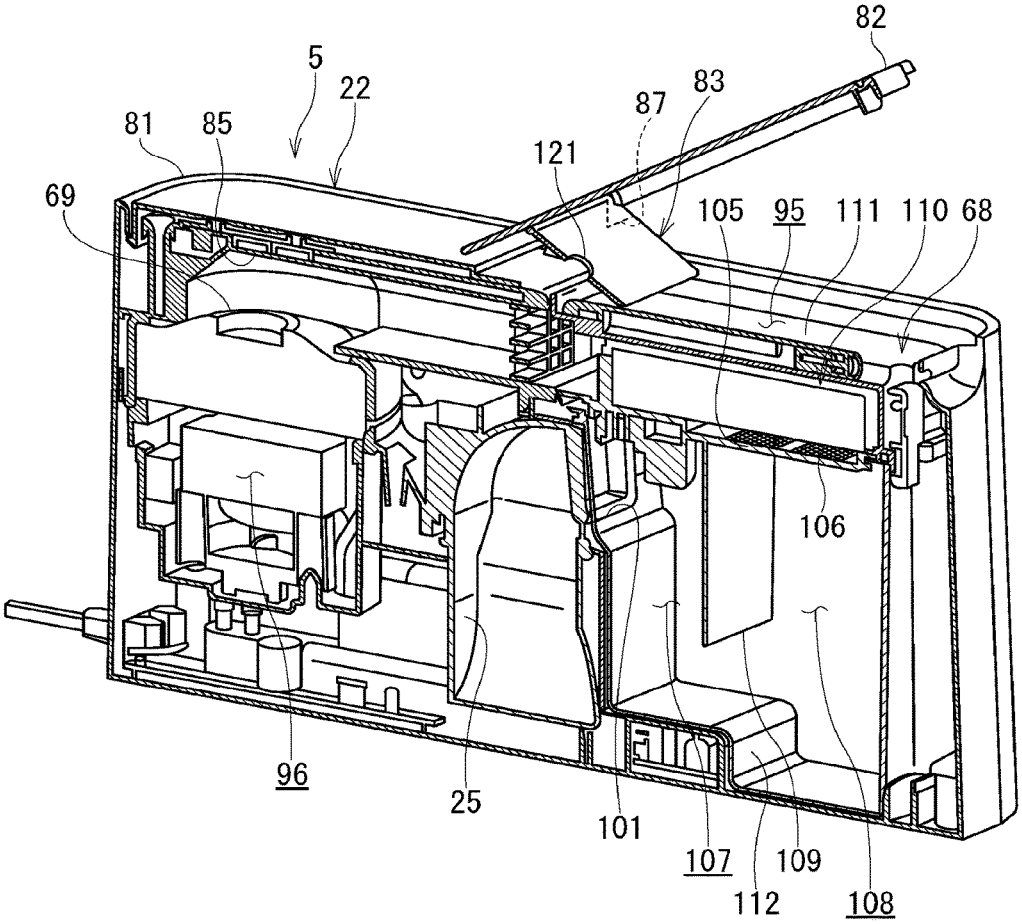
FIG. 9 is the cross sectional perspective view illustrating the station of the electric vacuum cleaner according to the embodiment of the present invention.

FIGS. 8 and 9 are cross sectional perspective views illustrating the station of the electric vacuum cleaner according to the embodiment of the present invention.

FIG. 8 illustrates a state where the lid 82 is fully open. FIG. 9 illustrates a state where the erroneous suction preventing section 83 begins to contact with the secondary dust container 68 while the lid 82 is closing.

As illustrated in FIG. 8, in the station 5 according to the embodiment, the secondary dust container 68 can be taken out of the dust container chamber 95 in the body 81 by opening the lid 82.

The rotation center of the lid 82 is located on a side of the blower chamber 96, and the lid 82 is opened so as to get closer to the blower chamber 96. The lid 82 is opened substantially perpendicularly to largely open an upper part of the dust container chamber 95.

The erroneous suction preventing section 83 is swingably supported by the lid 82, is along an inner surface of the lid 82 when the lid 82 is closed (FIG. 5), while it is tilted (swings) by its own weight and falls over when the lid 82 is opened. At this time, the claw 87 provided on the erroneous suction preventing section 83 regulates the inclination of the erroneous suction preventing section 83 at an appropriate angle. This appropriate angle is set to an angle so that the erroneous suction preventing section 83 should not inhibit hitting the secondary dust container 68 become the lid 82 should be smoothly closed. That is, as illustrated in FIG. 9, the claw 87 regulates the inclination of the erroneous suction preventing section 83 at the appropriate angle so that, in a course of closure of the lid 82, an angle formed by an outer shell of the secondary dust container 68 and the erroneous suction preventing section 83 becomes an acute angle when the erroneous suction preventing section 83 is brought into contact with the secondary dust container 68, and the erroneous suction preventing section 83 tilts and falls over the inner surface of the lid 82 (FIG. 5) by further closing of the lid 82.

Figure 10:
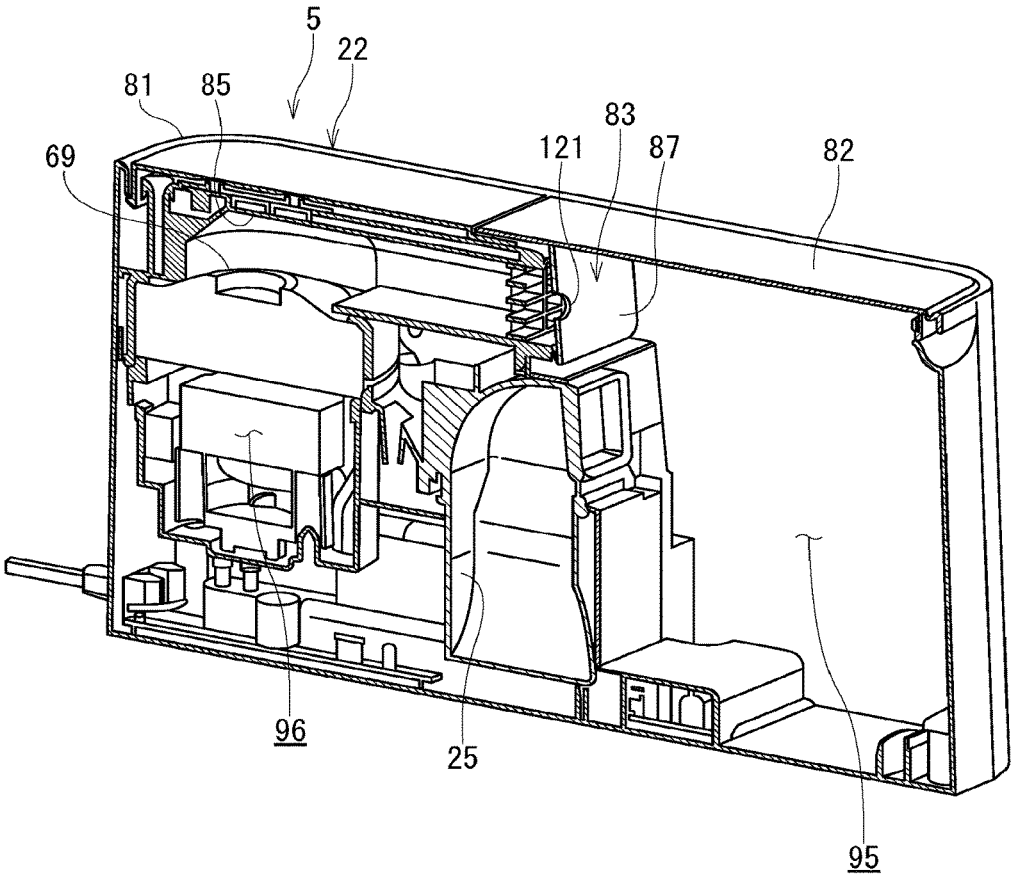
FIG. 10 is the cross sectional perspective view illustrating the station of the electric vacuum cleaner according to the embodiment of the present invention.

FIG. 10 is a cross sectional perspective view illustrating the station of the electric vacuum cleaner according to the embodiment of the present invention.

FIG. 10 illustrates a state where the secondary dust container 68 is removed from the station 5.

The dust transfer pipe 25 and the downstream pipe 85 of the station 5 according to the embodiment are fluidically connected through the dust container chamber 95 when the secondary dust container 68 is taken out of the dust container chamber 95. when the secondary electric blower 69 is operated in a state where the dust transfer pipe 25 and the downstream pipe 85 are fluidically connected through the dust container chamber 95, a negative pressure generated by the secondary electric blower 69 is applied to the dust transfer pipe 25 through the downstream pipe 85 and the dust container chamber 95. In this case, if the autonomous robotic vacuum cleaning unit 2 has returned to the home position, the dust in the primary dust container 12 might be scattered in the dust container chamber 95 or might be suctioned into the secondary electric blower 69.

Thus, the station 5 according to the embodiment shuts off fluidic connection between the downstream pipe 85 and the dust container chamber 95 by closing the inlet of the downstream pipe 85 with the erroneous suction preventing section 83 when the secondary dust container 68 is taken out of the dust container chamber 95 as illustrated in FIG. 10. Even if the secondary electric blower 69 is operated in a state where the inlet of the downstream pipe 85 is closed with the erroneous suction preventing section 83, the negative pressure generated by the secondary electric blower 69 presses the erroneous suction preventing section 83 onto the inlet of the downstream pipe 85 so that it does not act on the dust transfer pipe 25, and thus even if the autonomous robotic vacuum cleaning unit 2 returns to the home position, scattering of the dust in the primary dust container 12 in the dust container chamber 95 or suctioning thereof into the secondary electric blower 69 is prevented.

The ventilation hole 121 of the erroneous suction preventing section 83 leads the air into the downstream pipe 85 from an inside of the dust container chamber 95 in order to reduce a load imposed on the secondary electric blower 69 when the downstream pipe 85 is fully closed. An opening area of the ventilation hole 121 is set to be smaller than a channel sectional area of the downstream pipe 85 to avoid scattering of the dust in the primary dust container 12 in the dust container chamber 95 or suctioning thereof into the secondary electric blower 69 caused by the negative pressure acting on the dust container chamber 95.

The control section 93 monitors the negative pressure in the downstream pipe 85 by the pressure detecting section 91, and When the detection result of the pressure detecting section 91 indicates a pressure value lower than the pre-determination suction negative pressure value, the control section 93 activates the alarm section 92 and notifies that the amount of the dust accumulated in the secondary dust container 68 has reached the pre-determination specified amount. This dust amount notification control of the control section 93 effectively also functions when the secondary dust container 68 is taken out of the dust container chamber 95. That is, even if closure of the erroneous suction preventing section 83 raises the negative pressure in the downstream pipe 85 and the detection result of the pressure detecting section 91 indicates a pressure value lower than the pre-determination suction negative pressure value, the control section 93 activates the alarm section 92 and notifies that the dust accumulated in the secondary dust container 68 has reached the pre-determination specified amount.

That is, in the electric vacuum cleaner 1, even if an operation is started in a state where the secondary dust container 68 is detached from the dust container chamber 95 and the dust is to be transferred from the autonomous robotic vacuum cleaning unit 2 to the station 5, the erroneous suction preventing section 83 prevents the transfer of the dust, and a rise in the negative pressure in the downstream pipe 85 activates the alarm section 92 notifies. This alarm makes a user of the electric vacuum cleaner 1 notice that the secondary dust container 68 has not been attached.

Figure 11:
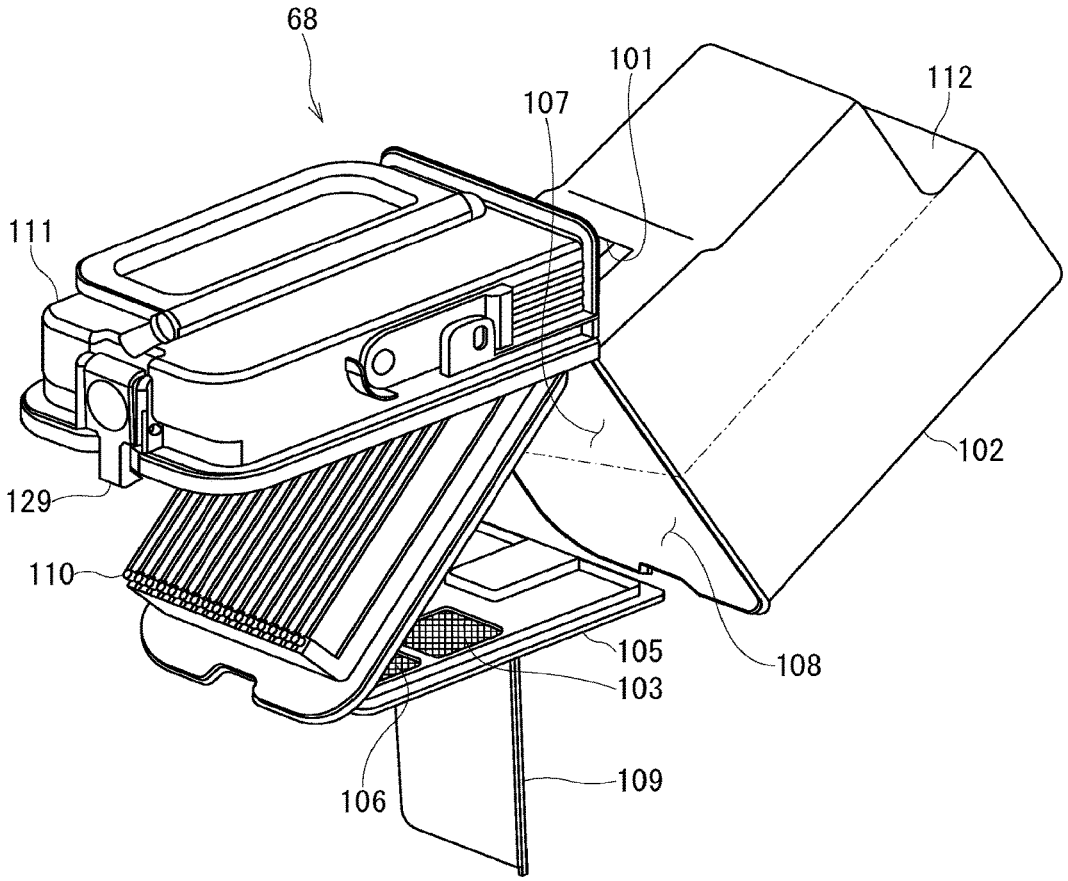
FIG. 11 is a perspective view illustrating a secondary dust container of the electric vacuum cleaner according to the embodiment of the present invention.
Figure 12:
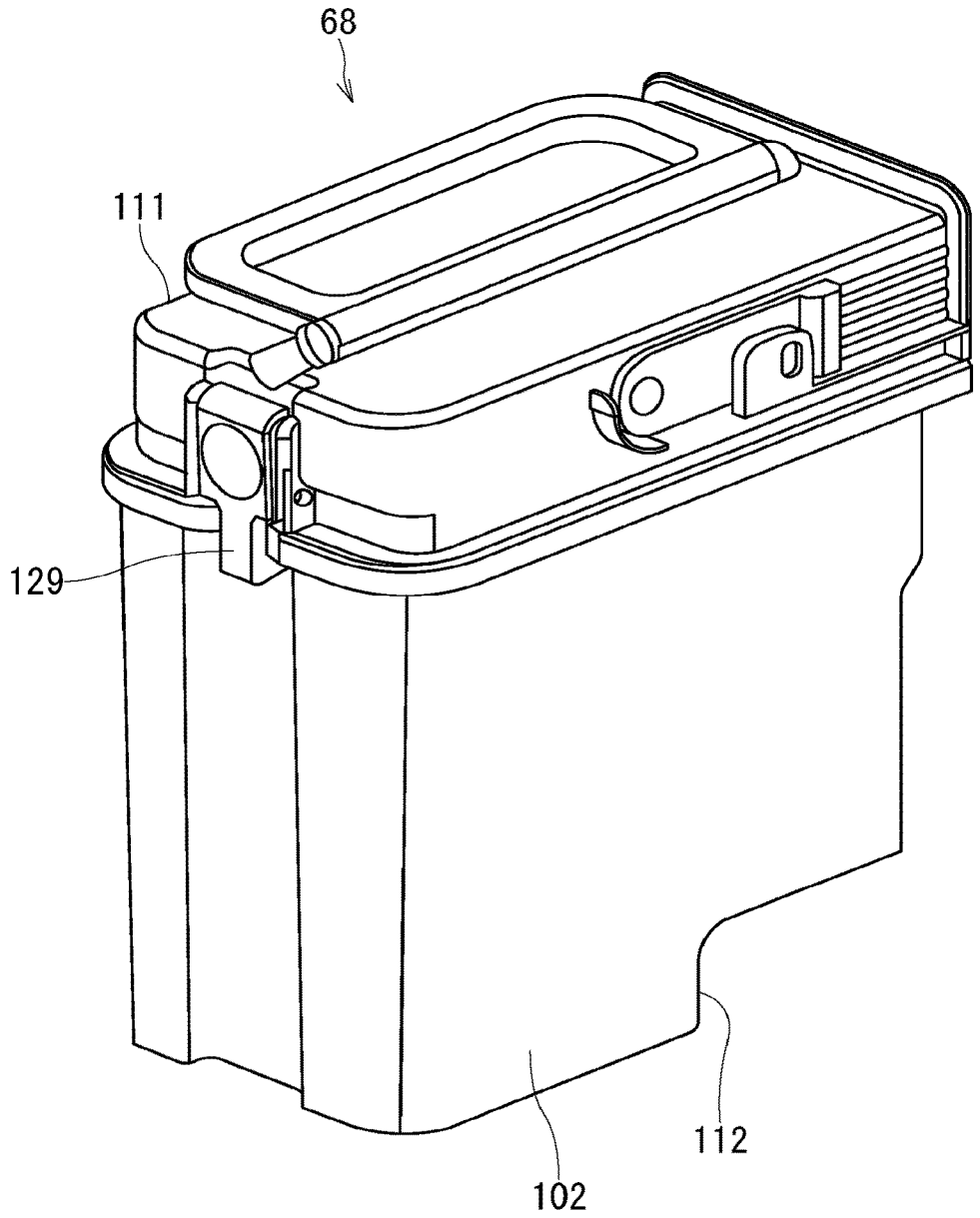
FIG. 12 is the perspective view illustrating the secondary dust container of the electric vacuum cleaner according to the embodiment of the present invention.

FIGS. 11 and 12 are perspective views illustrating the secondary dust container of the electric vacuum cleaner according to the embodiment of the present invention.

FIG. 11 illustrates the secondary dust container 68 in a state of being accommodated in the station 5, and FIG. 12 illustrates the secondary dust container 68 when the dust is discharged therefrom or the filter therein is cleaned.

As illustrated in FIGS. 20 and 21, the secondary dust container 68 of the station 5 according to the embodiment discharges the dust accumulated in the downstream space 108 by the partition plate 113 so as to scrape it out from the inside of the dust container 102 by opening the lid 105 with the first hinge mechanism 115.

The secondary dust container 68 enables the fine dust accumulated in the protruding section 112 to be discharged therefrom in a state where the dust is not scattered easily by opening the lid 105 with the first hinge mechanism 115.

In the secondary dust container 68, a filtering surface of the secondary filter 110 can be exposed for cleaning by opening the lid 105 with the second hinge mechanism 116.

The cover pipe 111 can also be opened around the first hinge mechanism 115 and cleaned by exposing a back side of the secondary filter 110.

The cover pipe 111, the secondary filter 110, and the lid 105 are opened by releasing an opening and closing hook 129 provided on the cover pipe 111.

The electric vacuum cleaner 1 according to the embodiment includes the primary dust container 12 detachably provided in the autonomous robotic vacuum cleaning unit 2, the dust is accumulated in the station 5 in usual so as to avoid cumbersome maintenance or cleaning of the primary dust container 12, while if clogging occurs in the filter in the primary dust container 12 due to use for a long time, for example, the primary dust container 12 is detached from the autonomous robotic vacuum cleaning unit 2 so that maintenance or cleaning of the primary dust container 12 is performed independently, which is highly maintainable.

The electric vacuum cleaner 1 according to the embodiment includes the primary dust container 12 detachably provided in the autonomous robotic vacuum cleaning unit 2, if an air passage for transfer of the dust from the primary dust container 12 to the station 5 is connected in steps between the primary dust container 12 and the body case 11 of the autonomous robotic vacuum cleaning unit 2 and between the body case 11 and the station 5, too many joints in the channel increase a risk of leakage of the dust. Thus, The electric vacuum cleaner 1 according to this embodiment connects the station 5 directly to the connecting part 39 of the primary dust container 12, the joints of the air passage are minimized, and the risk of leakage to an outside of the air passage of the dust to be transferred from the primary dust container 12 to the station 5 is made extremely small.

The electric vacuum cleaner 1 according to the embodiment connects the station 5 directly to the connecting part 39 of the primary dust container 12, even if fluctuation of the home position is large (even if accuracy of fixation is low) in the return control (homing control) of the autonomous robotic vacuum cleaning unit 2, an influence of the joint in the air passage for transferring the dust is minimized.

The electric vacuum cleaner 1 according to the embodiment includes the disposal port 41, which discharges the dust from the primary dust container 12, opened downward of the autonomous robotic vacuum cleaning unit 2, and the dust transfer pipe 25, which receives the dust into the station 5, opened upward, so that the dust in the primary dust container 12 is discharged smoothly.

The electric vacuum cleaner 1 according to the embodiment includes the disposal port 41 arranged closer to the station 5 than to the center of the autonomous robotic vacuum cleaning unit 2, in a state where the autonomous robotic vacuum cleaning unit 2 is at the home position, since it has the disposal port 41 arranged on a side closer to the station 5 than to the center of the autonomous robotic vacuum cleaning unit 2, so that the air passages of the autonomous robotic vacuum cleaning unit 2 and the station 5 are arranged with convenience, the air passage lengths of the autonomous robotic vacuum cleaning unit 2 and the station 5 are reduced, a size of the autonomous robotic vacuum cleaning unit 2 and the station 5 are reduced, and a capacity of the primary dust container 12 is ensured easily.

The electric vacuum cleaner 1 according to the embodiment fits the connecting part 39 of the primary dust container 12 into the dust container opening 37 of the autonomous robotic vacuum cleaning unit 2, so that the primary dust container 12 is reliably positioned to the body case 11 of the autonomous robotic vacuum cleaning unit 2, and the primary dust container 12 is reliably positioned to the station 5 at the home position.

The electric vacuum cleaner 1 according to the embodiment includes the connecting part 39 of the primary dust container 12 flush with the outer surface of the body case 11 of the autonomous robotic vacuum cleaning unit 2, so that the autonomous robotic vacuum cleaning unit 2 smoothly moves without hooking objects by the dust container opening 37 or the connecting part 39, for example.

The electric vacuum cleaner 1 according to the embodiment includes the disposal lid 42 of the primary dust container 12 flush with the outer surface of the body case 11 of the autonomous robotic vacuum cleaning unit 2, the autonomous robotic vacuum cleaning unit 2 smoothly moves without hooking objects by the dust container opening 37 or the disposal lid 42, for example.

Therefore, the electric vacuum cleaner 1 according to the embodiment can reliably prevent leakage of dust in the transfer path for dust from the primary dust container 12 of the autonomous robotic vacuum cleaning unit 2 to the station 5.

While certain embodiment has been described, this embodiment has been presented by way of example only, and is not intended to limit the scope of the inventions. Indeed, the novel embodiment described herein may be embodied in a variety of other forms; furthermore, various omissions, substitutions and changes in the form of the embodiment described herein may be made without departing from the spirit of the inventions. The accompanying claims and their equivalents are intended to cover such forms or modifications as would fall within the scope and spirit of the inventions.

REFERENCE SIGNS LIST

1 electric vacuum cleaner
2 autonomous robotic vacuum cleaning unit
3 charging electrode
5 station
11 body case
11*a* bottom face
12 primary dust container
13 primary electric blower
15 moving section
16 wheel driving section
17 robot controller
18 rechargeable battery
21 base
22 dust collecting section
23 roller pair
25 dust transfer pipe
25*a* sealing member
26 lever
29 power cord
31 center brush
32 center brush driving section
33 side brush
35 side brush driving section
36 suction port
37 dust container opening
38 container body
39 connecting part
41 disposal port
42 disposal lid
45 driving wheel
46 turning wheel
47 charging terminal
48 brush base section
49 linear cleaning body
61 high floor section
62 low floor section
63 cross direction roller
65 stopper roller
66 running surface
68 secondary dust container
69 secondary electric blower
71 recessed section
72 homing detector
73 first sensor
75 second sensor
81 body
82 lid
83 erroneous suction preventing section

85 downstream pipe
86 sealing surface
87 claw
91 pressure detecting section
92 alarm section
93 control section
95 dust container chamber
96 blower chamber
97 hook
101 suction port
102 dust container
103 discharge port
105 lid
106 net filter
107 upstream space
108 downstream space
109 partition plate
110 secondary filter
111 cover pipe
112 protruding section
113 partition plate
115 first hinge mechanism
116 second hinge mechanism
121 ventilation hole
123 lever receiver
125 shaft cover
126 cover body
127 coil spring
129 opening and closing hook

The invention claimed is:

1. An electric vacuum cleaner comprising:

an autonomous robotic vacuum cleaning unit autonomously moving on a surface to be cleaned and collecting dust on the surface; and a station unit, wherein the autonomous robotic vacuum cleaning unit includes:

a body case having a dust container opening; and a primary dust container including a container body detachably provided in the body case and accumulating the dust collected by the autonomous robotic vacuum cleaning unit, a connecting part exposed from the dust container opening or facing the dust container opening in a state attached to the body case, a disposal port provided on the connecting part and through which the dust in the container body is discharged, and a disposal lid for opening and closing the disposal port; and the station unit includes:

a dust transfer pipe connected to the disposal port in contact with the connecting part of the primary dust container;

a secondary dust container for accumulating the dust discharged from the primary dust container through the dust transfer pipe; and a lever hooked by the disposal lid, and opening the disposal lid to fluidically connect the disposal port and the dust transfer pipe to each other, wherein the disposal lid and the lever swing around a rotation center line crossing a direction toward a home position of the autonomous robotic vacuum cleaning unit.

2. The electric vacuum cleaner according to claim 1, wherein the disposal port is opened downward of the autonomous robotic vacuum cleaning unit; and the dust transfer pipe is opened upward of the station.

3. The electric vacuum cleaner according to claim 1, wherein the disposal port is arranged closer to the station than to a center of the autonomous robotic vacuum cleaning unit.

4. The electric vacuum cleaner according to claim 1, wherein the connecting part is fitted with the dust container opening.

5. The electric vacuum cleaner according to claim 1, wherein the connecting part is flush with an outer surface of the body case.

6. The electric vacuum cleaner according to claim 1, wherein the disposal lid is flush with the outer surface of the body case.

7. The electric vacuum cleaner according to claim 2, wherein the disposal port is arranged closer to the station than to a center of the autonomous robotic vacuum cleaning unit.

8. The electric vacuum cleaner according to claim 2, wherein the connecting part is fitted with the dust container opening.

9. The electric vacuum cleaner according to claim wherein the connecting part is fitted with the dust container opening.

10. The electric vacuum cleaner according to claim 7, wherein the connecting part is fitted with the dust container opening.

11. The electric vacuum cleaner according to claim 2, wherein the connecting part is flush with an outer surface of the body case.

12. The electric vacuum cleaner according to claim 3, wherein the connecting part is flush with an outer surface of the body case.

13. The electric vacuum cleaner according to claim 4, wherein the connecting part is flush with an outer surface of the body case.

14. The electric vacuum cleaner according to claim 2, wherein the disposal lid is flush with the outer surface of the body case.

15. The electric vacuum cleaner according to claim 3, wherein the disposal lid is flush with the outer surface of the body case.

16. The electric vacuum cleaner according to claim 4, wherein the disposal lid is flush with the outer surface of the body case.

17. The electric vacuum cleaner according to claim 10, wherein the disposal lid is flush with the outer surface of the body case.

* * * * *